US010986891B2

(12) United States Patent
Mokos et al.

(10) Patent No.: US 10,986,891 B2
(45) Date of Patent: Apr. 27, 2021

(54) SHOE HAVING CUSHION WITHIN HEEL MEMBER

(71) Applicant: Cole Haan LLC, New York, NY (US)

(72) Inventors: Jeffrey Mokos, New York, NY (US); Caroline Swierszczyk, New York, NY (US); Brett Brown, New York, NY (US); Mathew Chapdelaine, Manchester, NH (US); Scott Patt, New York, NY (US)

(73) Assignee: COLE HAAN LLC, Greenland, NH (US)

( * ) Notice: Subject to any disclaimer, the term of this patent is extended or adjusted under 35 U.S.C. 154(b) by 44 days.

(21) Appl. No.: 16/240,163

(22) Filed: Jan. 4, 2019

(65) Prior Publication Data

US 2019/0208859 A1 Jul. 11, 2019

Related U.S. Application Data

(60) Provisional application No. 62/614,432, filed on Jan. 7, 2018.

(51) Int. Cl.
*A43B 7/14* (2006.01)
*A43B 13/18* (2006.01)
(Continued)

(52) U.S. Cl.
CPC ..... *A43B 7/144* (2013.01); *A43B 7/141* (2013.01); *A43B 7/145* (2013.01); *A43B 7/1445* (2013.01); *A43B 13/186* (2013.01); *A43B 7/1425* (2013.01); *A43B 13/12* (2013.01); *A43B 13/188* (2013.01); *A43B 17/14* (2013.01); *A43B 21/24* (2013.01)

(58) Field of Classification Search
CPC ..... A43B 7/144; A43B 7/141; A43B 7/1445; A43B 7/145; A43B 7/1425; A43B 17/14; A43B 21/24; A43B 13/12; A43B 13/141; A43B 13/146; A43B 13/187;
(Continued)

(56) References Cited

U.S. PATENT DOCUMENTS 5,983,529 A * 11/1999 Serna ..... A43B 1/0072 36/28
2007/0011914 A1* 1/2007 Keen ..... A43C 11/00 36/50.1

(Continued)

FOREIGN PATENT DOCUMENTS

EP 383489 A1 * 8/1990 ..... A43B 13/12

*Primary Examiner* — Khoa D Huynh
*Assistant Examiner* — Aiying Zhao
(74) *Attorney, Agent, or Firm* — Thompson Coburn LLP

(57) ABSTRACT

A shoe includes a sole and an upper secured to the sole. The sole has an outsole, a molded chassis, a forefoot cushion, and a heel cushion. The medial midfoot region of the outsole is devoid of the outsole such that the chassis member is visible as viewed in a bottom plan view. The molded chassis has a forefoot opening and a heel opening, with both the forefoot opening and the heel opening being through openings extending through the molded chassis. The forefoot opening is in one or more of the toe region and the ball region of the sole, and the heel opening is in the heel region of the sole. The forefoot cushion is in the forefoot opening, and the heel cushion is in the heel opening. The molded chassis is coupled to the outsole and coupled to the upper.

6 Claims, 13 Drawing Sheets

(51) Int. Cl.
*A43B 13/12* (2006.01)
*A43B 17/14* (2006.01)
*A43B 21/24* (2006.01)

(58) Field of Classification Search
CPC ... A43B 13/122; A43B 13/223; A43B 13/186; A43B 13/188; A43B 13/18; A43B 15/00
USPC ..... 36/103, 59 R, 59 C
See application file for complete search history.

(56) References Cited

U.S. PATENT DOCUMENTS

| | | | | |
|---|---|---|---|---|
| 2009/0293314 | A1* | 12/2009 | Dekovic | A43B 13/186 36/103 |
| 2012/0023781 | A1* | 2/2012 | Dojan | A43B 13/04 36/103 |
| 2012/0260535 | A1* | 10/2012 | Tsang | A43B 13/184 36/32 R |
| 2013/0042504 | A1* | 2/2013 | Yang | A43B 13/223 36/59 C |
| 2013/0152428 | A1* | 6/2013 | Bishop | A43B 13/16 36/103 |
| 2013/0291409 | A1* | 11/2013 | Reinhardt | B29D 35/122 36/30 R |
| 2014/0075779 | A1* | 3/2014 | Bruce | A43B 7/148 36/29 |
| 2018/0263335 | A1* | 9/2018 | Iuchi | A43B 13/122 |

* cited by examiner

SHOE HAVING CUSHION WITHIN HEEL MEMBER

CROSS-REFERENCE TO RELATED APPLICATIONS

This application claims the benefit of U.S. Provisional Application No. 62/614,432, filed Jan. 7, 2018, the entirety of which is hereby incorporated by reference.

STATEMENT REGARDING FEDERALLY SPONSORED RESEARCH OR DEVELOPMENT

Not Applicable.

APPENDIX

Not Applicable.

BACKGROUND

Field

This disclosure pertains to shoes having heel members.

SUMMARY

One aspect of the disclosure is a shoe including a sole and an upper secured to the sole. The sole extends longitudinally from a sole heel end to a sole toe end and extends transversely from a sole lateral edge to a sole medial edge. The sole includes a heel region, a midfoot region, a ball region and a toe region. The heel region extends longitudinally from the sole heel end to the midfoot region, and the midfoot region extends longitudinally from the heel region to the ball region. The midfoot region has a lateral midfoot region and a medial midfoot region, where the lateral midfoot region extends transversely from the lateral edge to the medial midfoot region, and the medial midfoot region extends transversely from the medial edge to the lateral midfoot region. The ball region extends longitudinally from the midfoot region to the toe region, and the toe region extends longitudinally from the ball region to the sole toe end. The sole has an outsole, a molded chassis, a forefoot cushion, and a heel cushion. The outsole has a heel portion, a midfoot portion, a ball portion, and a toe portion, where the heel portion extends from the sole heel end toward the midfoot region and from the sole medial edge to the sole lateral edge. The midfoot portion extends from the heel portion to the ball portion and is only in the lateral midfoot region. The medial midfoot region is devoid of the midfoot portion of the outsole such that the chassis member is visible as viewed in a bottom plan view. The ball portion of the outsole extends from the midfoot portion toward the sole toe end and from the sole medial edge to the sole lateral edge. The toe portion of the outsole extends from the ball portion to the sole toe end and from the sole medial edge to the sole lateral edge. The molded chassis has a forefoot opening and a heel opening, with both the forefoot opening and the heel opening being through openings extending through the molded chassis. The forefoot opening is in one or more of the toe region and the ball region of the sole, and the heel opening is in the heel region of the sole. The forefoot cushion is in the forefoot opening, and the heel cushion is in the heel opening. The molded chassis is coupled to the outsole and coupled to the upper.

Another aspect of the disclosure is a shoe including a sole and an upper secured to the sole. The sole extends longitudinally from a sole heel end to a sole toe end and extends transversely from a sole lateral edge to a sole medial edge. The sole includes a heel region, a midfoot region, a ball region and a toe region. The heel region extends longitudinally from the sole heel end to the midfoot region, and the midfoot region extends longitudinally from the heel region to the ball region. The midfoot region has a lateral midfoot region and a medial midfoot region, where the lateral midfoot region extends transversely from the lateral edge to the medial midfoot region, and the medial midfoot region extends transversely from the medial edge to the lateral midfoot region. The ball region extends longitudinally from the midfoot region to the toe region, and the toe region extends longitudinally from the ball region to the sole toe end. The sole has an outsole and a chassis. The outsole has a heel portion, a midfoot portion, a ball portion, and a toe portion. The heel portion extends from the sole heel end toward the midfoot region and from the sole medial edge to the sole lateral edge. The midfoot portion extends from the heel portion to the ball portion and being only in the lateral midfoot region. The medial midfoot region is devoid of the midfoot portion of the outsole such that the chassis member is visible as viewed in a bottom plan view. The ball portion of the outsole extends from the midfoot portion toward the sole toe end and from the sole medial edge to the sole lateral edge, and the toe portion of the outsole extends from the ball portion to the sole toe end and from the sole medial edge to the sole lateral edge. The chassis is coupled to the outsole and coupled to the upper.

Another aspect of the disclosure is a shoe including a sole and an upper secured to the sole. The sole extends longitudinally from a sole heel end to a sole toe end and extends transversely from a sole lateral edge to a sole medial edge. The sole includes a heel region, a midfoot region, a ball region and a toe region. The heel region extends longitudinally from the sole heel end to the midfoot region, and the midfoot region extends longitudinally from the heel region to the ball region. The midfoot region has a lateral midfoot region and a medial midfoot region, where the lateral midfoot region extends transversely from the lateral edge to the medial midfoot region, and the medial midfoot region extends transversely from the medial edge to the lateral midfoot region. The ball region extends longitudinally from the midfoot region to the toe region, and the toe region extends longitudinally from the ball region to the sole toe end. The sole has a an outsole, a molded chassis, a forefoot cushion, and a heel cushion. The outsole extends from the sole heel end to the sole toe end and from the sole medial edge to the sole lateral edge. The molded chassis has a forefoot opening and a heel opening, with both the forefoot opening and the heel opening being through openings extending through the molded chassis. The forefoot opening is in one or more of the toe region and the ball region of the sole. The forefoot opening is in the heel region of the sole. The forefoot cushion is in the forefoot opening, and the heel cushion is in the heel opening. The molded chassis is coupled to the outsole and coupled to the upper.

Another aspect of the disclosure is a shoe including a sole and an upper secured to the sole. The sole extends longitudinally from a sole heel end to a sole toe end and extends transversely from a sole lateral edge to a sole medial edge. The sole includes a heel region, a midfoot region, a ball region and a toe region. The heel region extends longitudinally from the sole heel end to the midfoot region, and the midfoot region extends longitudinally from the heel region to the ball region. The midfoot region has a lateral midfoot region and a medial midfoot region, where the lateral midfoot region extends transversely from the lateral edge to the medial midfoot region, and the medial midfoot region extends transversely from the medial edge to the lateral midfoot region. The ball region extends longitudinally from the midfoot region to the toe region, and the toe region extends longitudinally from the ball region to the sole toe end. The sole has an outsole with a top surface and a bottom surface. The outsole has a plurality of longitudinal sipes and a plurality of transverse sipes. Each sipe of the plurality of longitudinal sipes extends away from the sole heel end and toward the sole toe end, and each sipe of the plurality of transverse sipes extends away from the sole lateral edge and toward the sole medial edge. Each sipe of the plurality of longitudinal sipes extends upward from the bottom surface, and each sipe of the plurality of transverse sipes extends upward from the bottom surface. Each longitudinal sipe is an undulating curve with peaks and troughs, and each transverse sipe is an undulating curve with peaks and troughs. Each peak of each longitudinal sipe is closer to the sole medial edge than an adjacent inflection point of such same longitudinal sipe is to the sole medial edge. Each trough of each longitudinal sipe is closer to the sole lateral edge than an adjacent inflection point of such same longitudinal sipe is to the sole lateral edge.

Further features and advantages of the present disclosure, as well as the operation of the embodiments described herein, are described in detail below with reference to the accompanying drawings.

Figure 1:
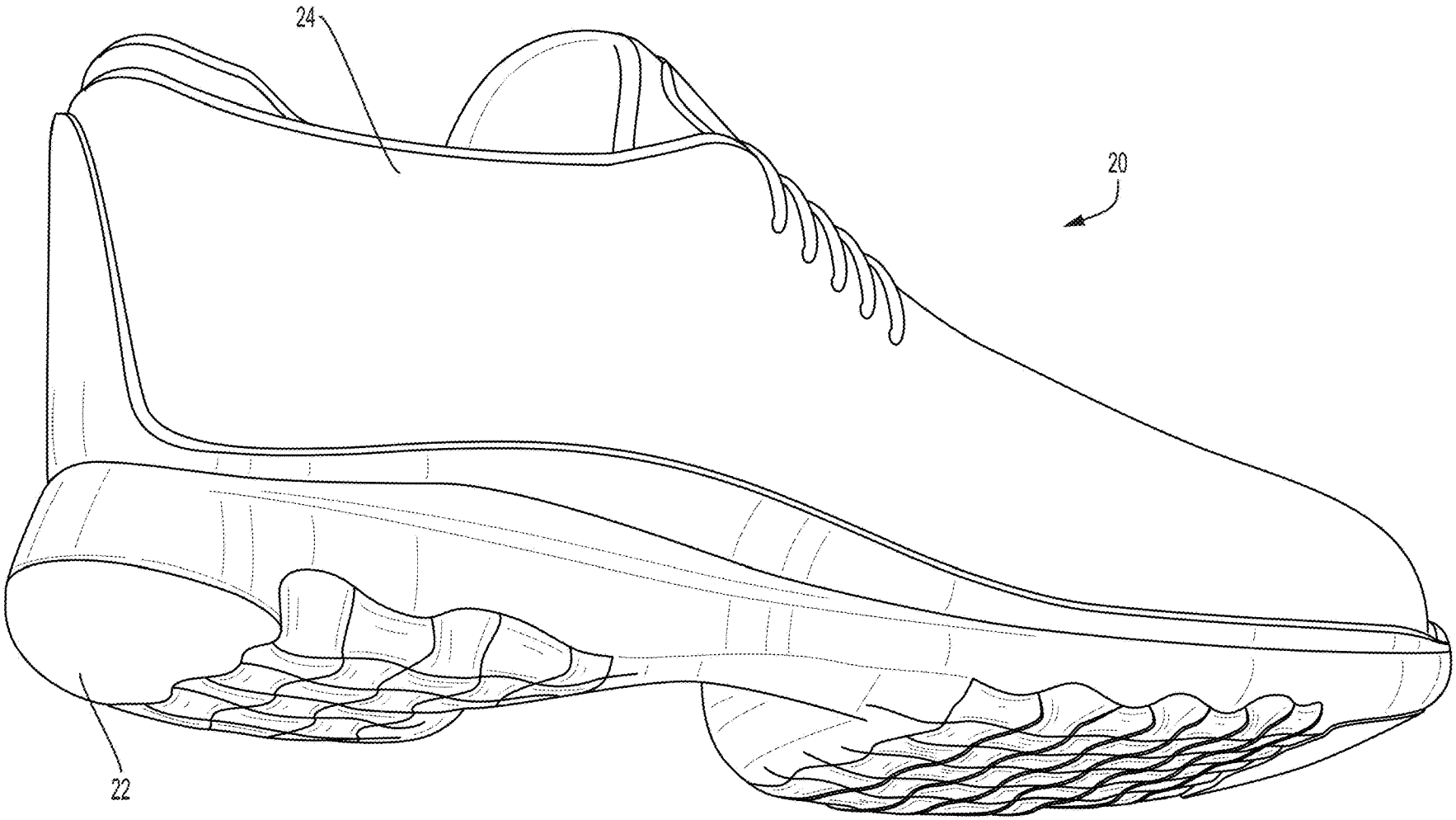
FIG. 1 is a perspective view of an embodiment of a shoe, the shoe including a chassis and a sole, the sole having an outsole and a chassis.

Reference numerals in the written specification and in the drawing figures indicate corresponding items.

DETAILED DESCRIPTION

An embodiment of a shoe in accordance with the present disclosure is indicated by reference numeral 20 in FIGS. 1-27. The shoe 20 comprises a sole, generally indicated at 22, and an upper, generally indicated at 24. The upper 24 is secured to the sole 22. The sole 22 has a chassis member 26, a heel cushion 28, a forefoot cushion 30, and an outsole 32. The sole 22 extends longitudinally from a sole heel end 38 to a sole toe end 40 and extends transversely from a sole lateral edge 42 to a sole medial edge 44. The sole 22 includes a heel region 46, a midfoot region 48, a ball region 50, and a toe region 52. The heel region 46 extends longitudinally from the sole heel end 38 to the midfoot region 48. The midfoot region 48 extends longitudinally from the heel region 46 to the ball region 50. The midfoot region 48 further includes a lateral midfoot region 34 and a medial midfoot region 36, both within the midfoot region 48. The lateral midfoot region 34 extends transversely from the sole lateral edge 42 to the medial midfoot region 36. The medial midfoot region 36 extends transversely from the medial edge 44 to the lateral midfoot region 34. The ball region 50 extends longitudinally from the midfoot region 48 to the toe region 52. The toe region 52 extends longitudinally from the ball region 50 to the sole toe end 40.

Figure 2:
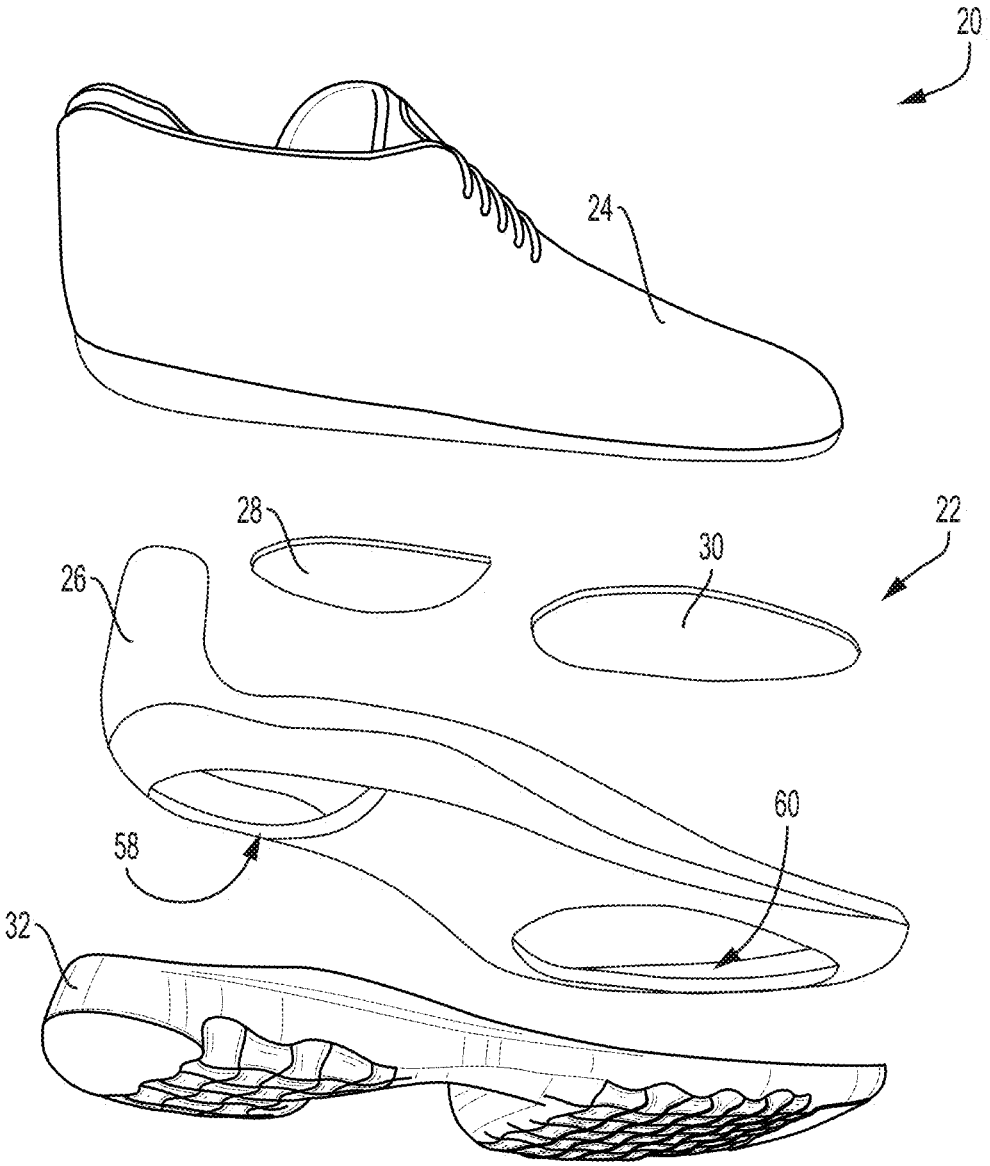
FIG. 2 is an exploded view of the shoe shown in FIG. 1 depicting an outsole, chassis, forefoot cushion, heel cushion, and upper.
Figure 3:
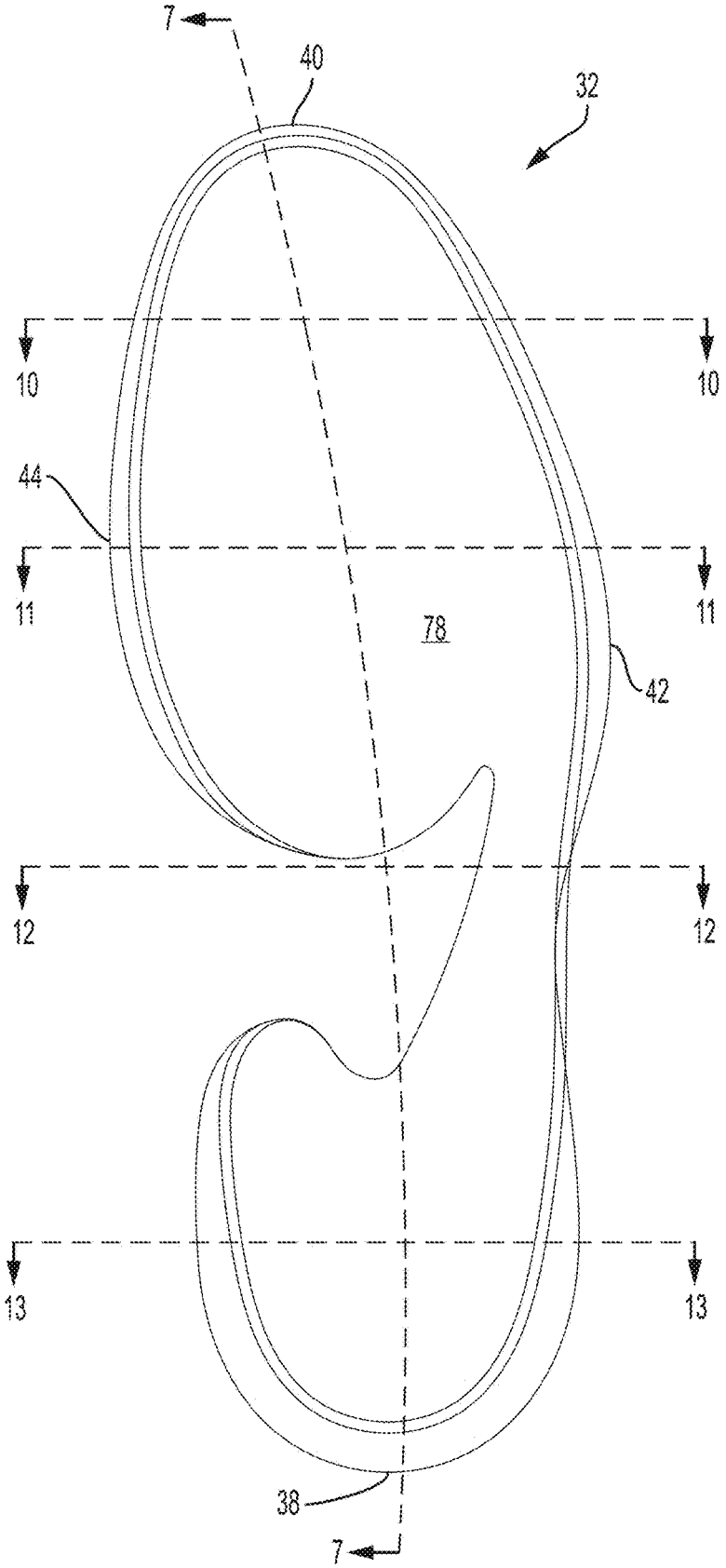
FIG. 3 is a top view of the outsole shown in FIG. 1.
Figure 4:
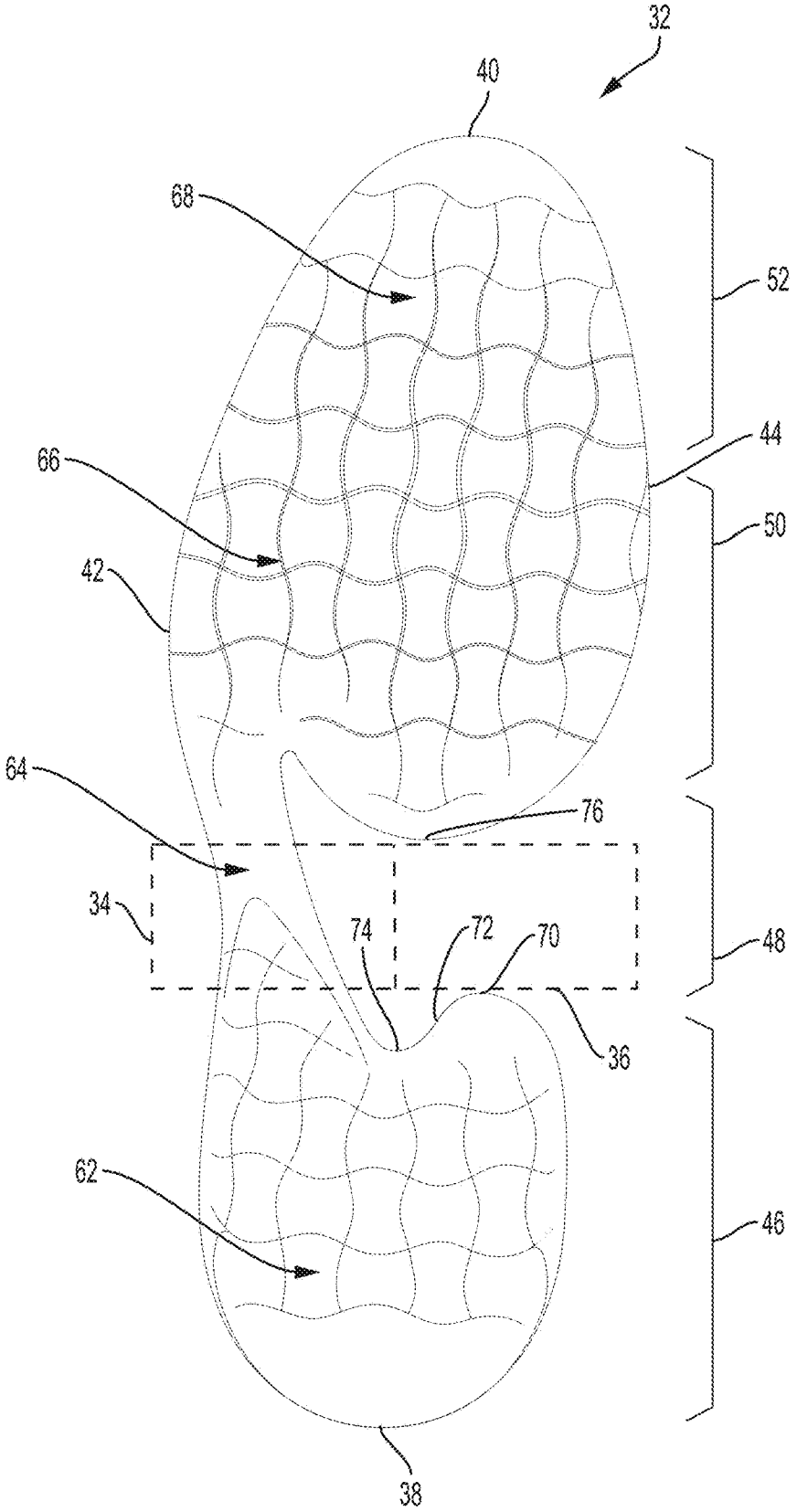
FIG. 4 is a bottom view of the outsole shown in FIG. 3.
Figure 5:
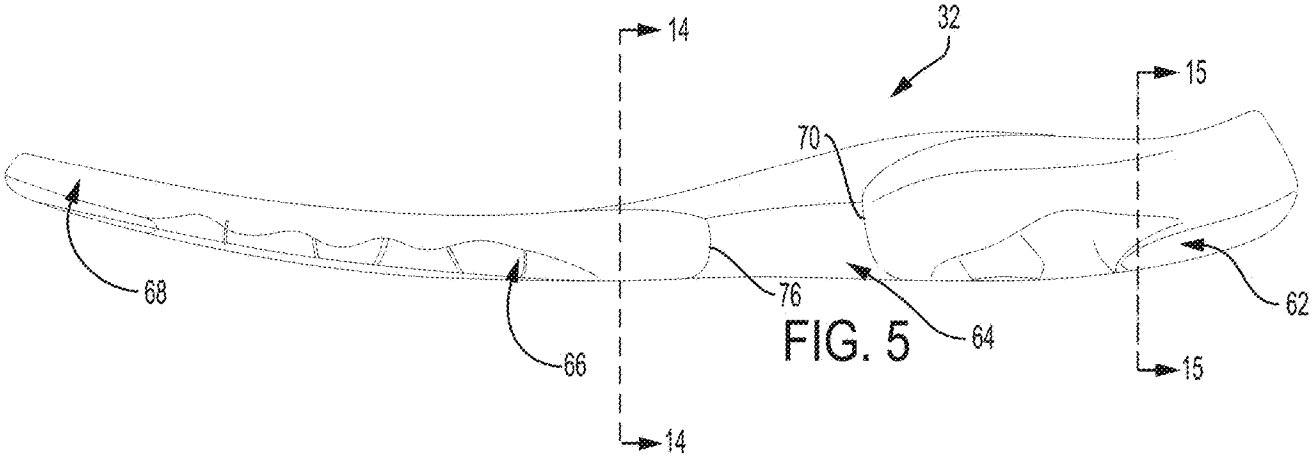
FIG. 5 is a medial side, elevation view of the outsole shown in FIG. 3.
Figure 6:
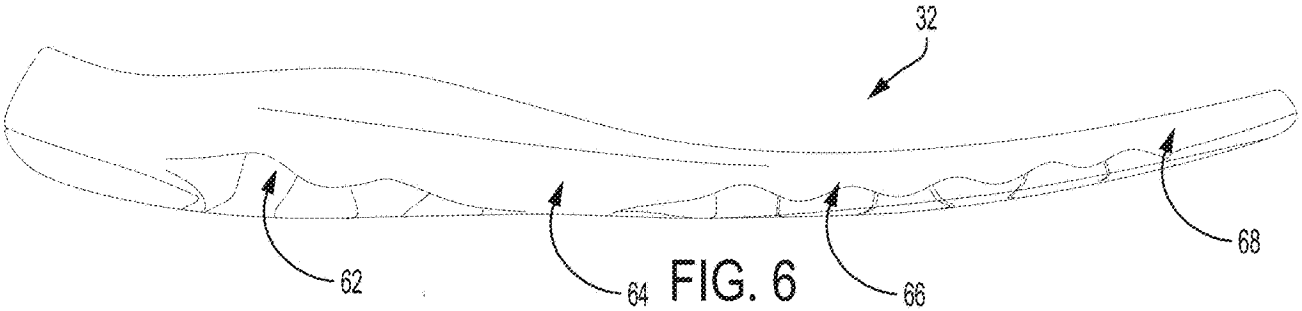
FIG. 6 is a lateral side, elevation view of the outsole shown in FIG. 3.
Figure 7:
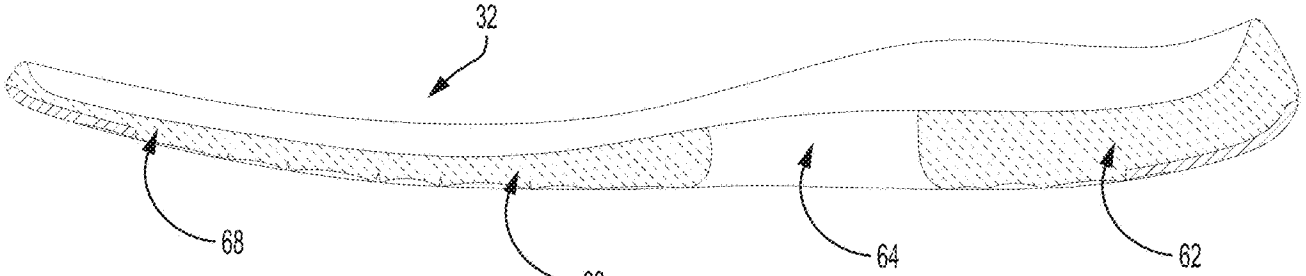
FIG. 7 is a cross-sectional view taken along the plane of line 7-7 of FIG. 3.
Figure 8:
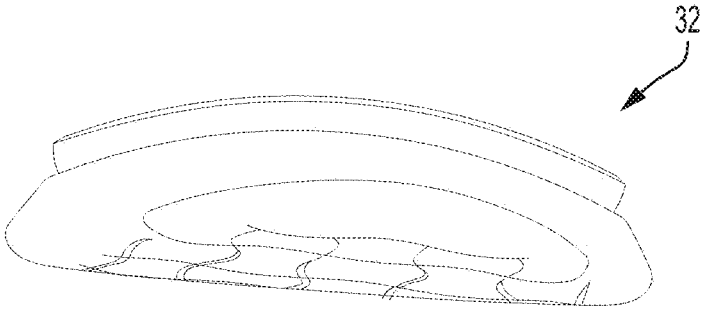
FIG. 8 is a front, elevation view of the outsole shown in FIG. 3.
Figure 9:
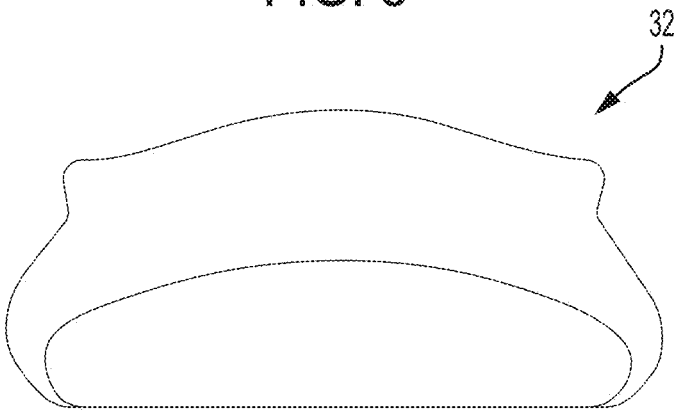
FIG. 9 is a rear, elevation view of the outsole shown in FIG. 3.
Figure 10:
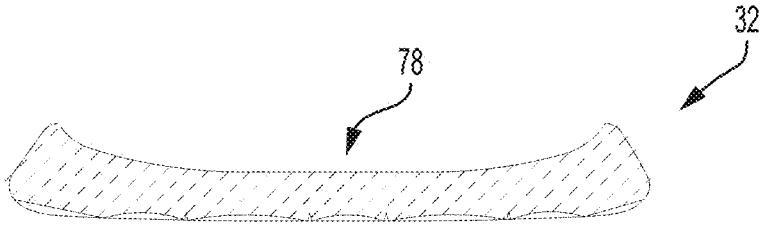
FIG. 10 is a cross-sectional view taken along the plane of line 10-10 of FIG. 3.
Figure 11:
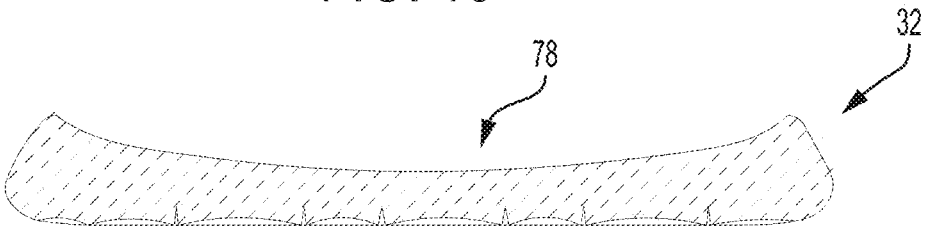
FIG. 11 is a cross-sectional view taken along the plane of line 11-11 of FIG. 3.
Figure 12:
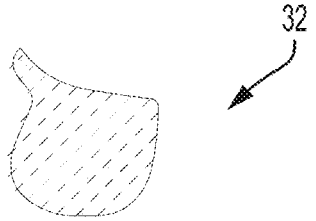
FIG. 12 is a cross-sectional view taken along the plane of line 12-12 of FIG. 3.
Figure 13:
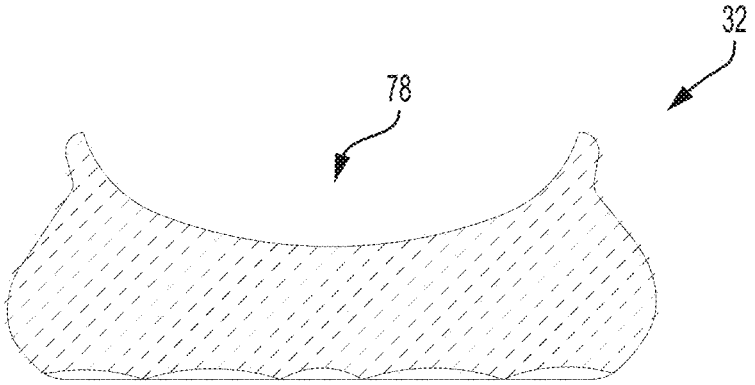
FIG. 13 is a cross-sectional view taken along the plane of line 13-13 of FIG. 3.
Figure 14:
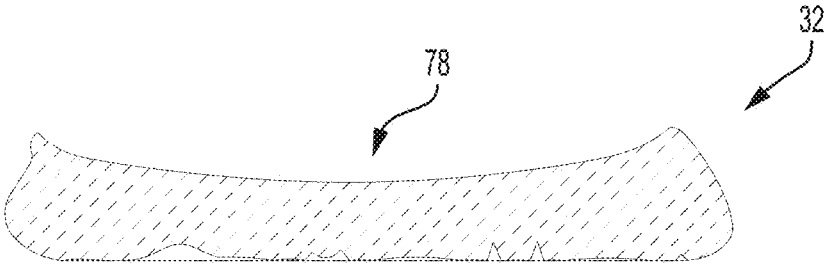
FIG. 14 is a cross-sectional view taken along the plane of line 14-14 of FIG. 5.
Figure 15:
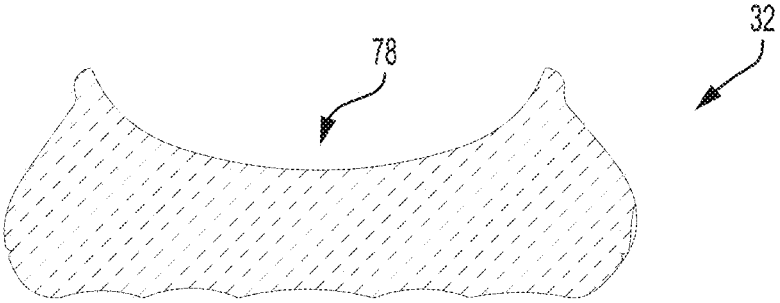
FIG. 15 is a cross-sectional view of a portion of the outsole shown in FIG. 3 taken along the line 15-15.
Figure 16:
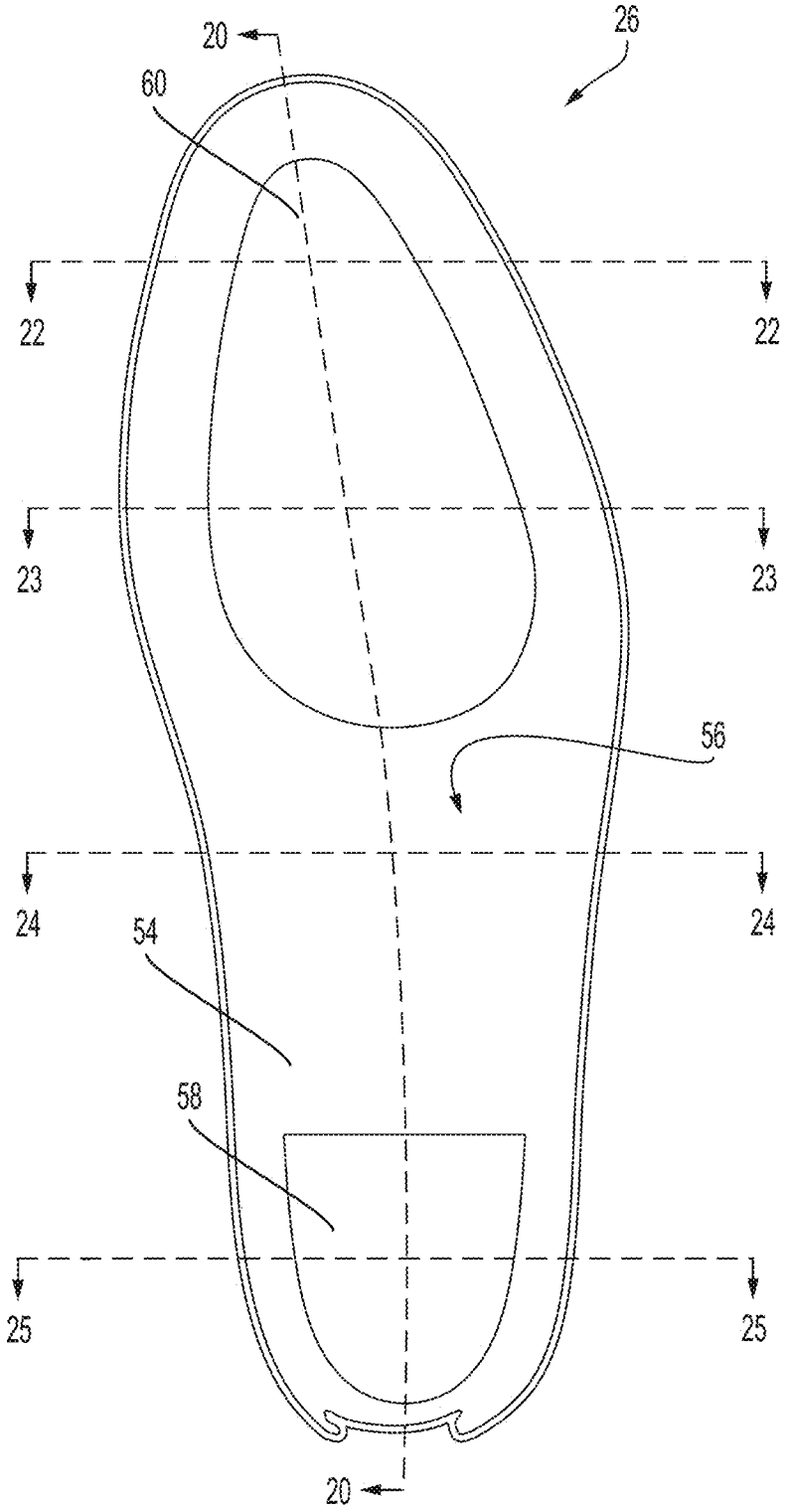
FIG. 16 is a top view of the chassis shown in FIG. 1.
Figure 17:
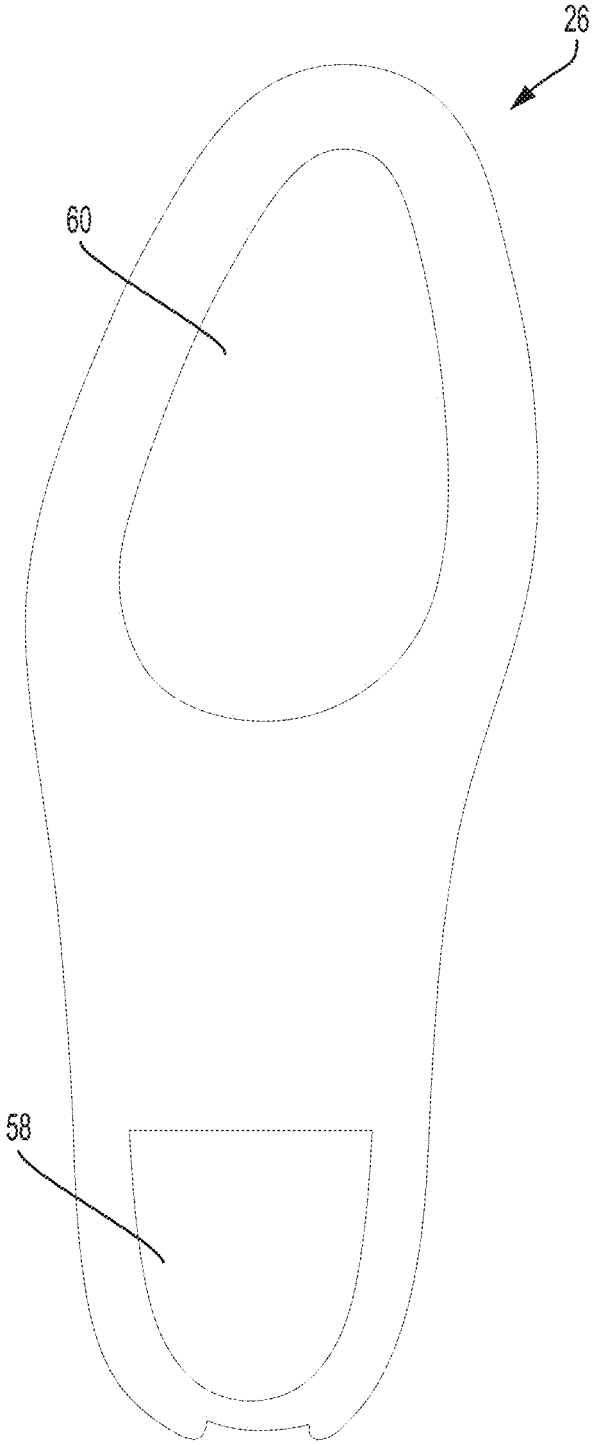
FIG. 17 is a bottom view of the chassis shown in FIG. 16.
Figure 18:
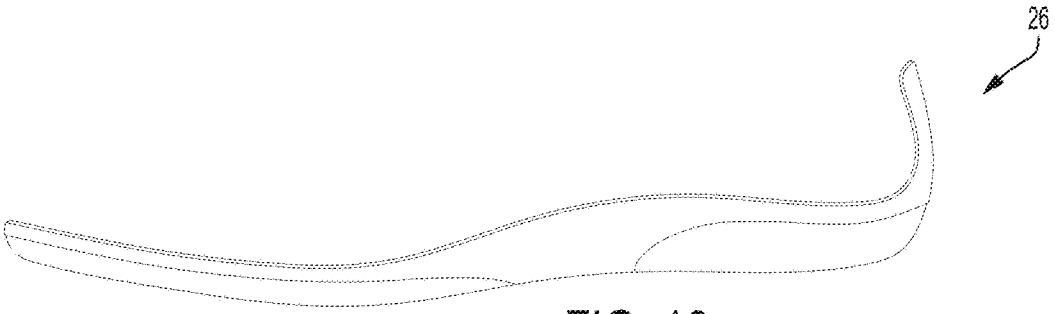
FIG. 18 is a medial side, elevation view of the chassis shown in FIG. 16.
Figure 19:
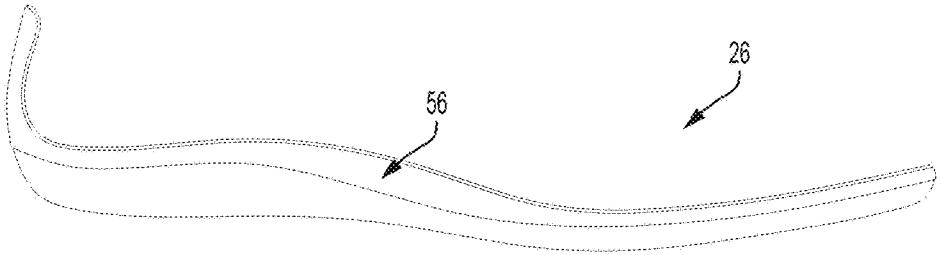
FIG. 19 is a lateral side, elevation view of the chassis shown in FIG. 16.
Figure 20:
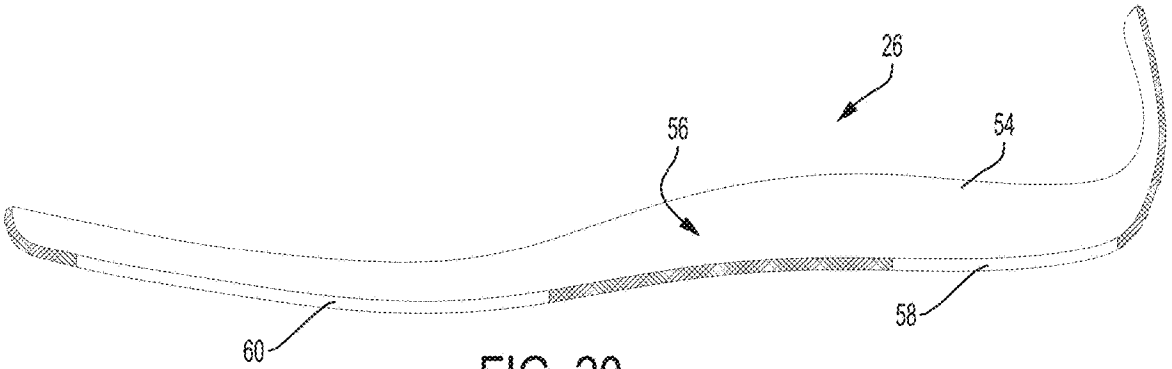
FIG. 20 is a cross-sectional view taken along the plane of line 20-20 of FIG. 16.
Figure 21:
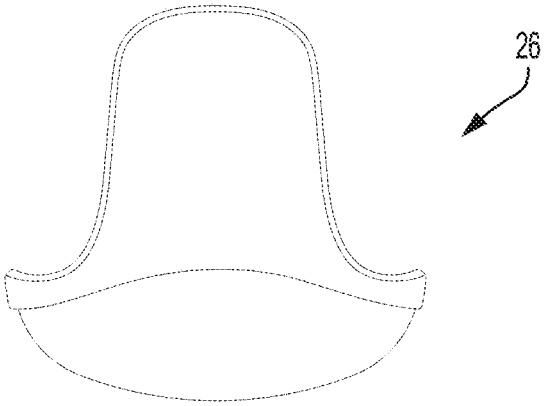
FIG. 21 is a rear, elevation view of the chassis shown in FIG. 16.
Figure 22:
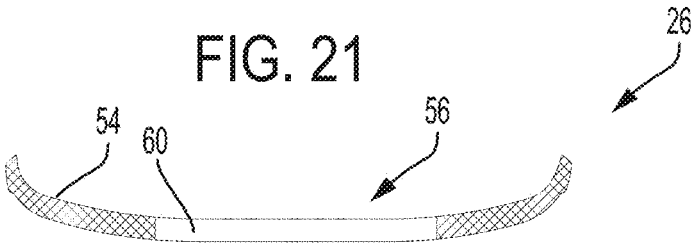
FIG. 22 is a cross-sectional view taken along the plane of line 22-22 of FIG. 16.
Figure 23:
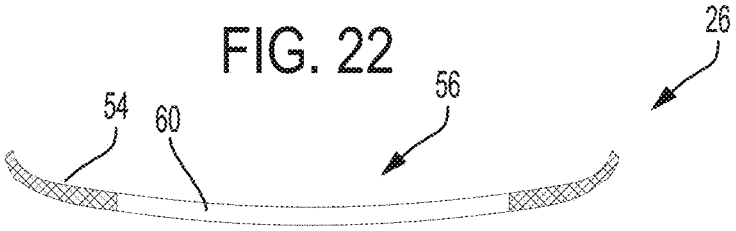
FIG. 23 is a cross-sectional view taken along the plane of line 23-23 of FIG. 16.
Figure 24:
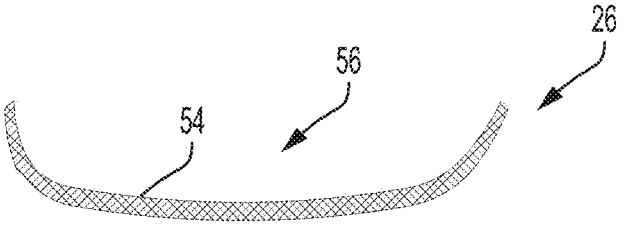
FIG. 24 is a cross-sectional view taken along the plane of line 24-24 of FIG. 16.
Figure 25:
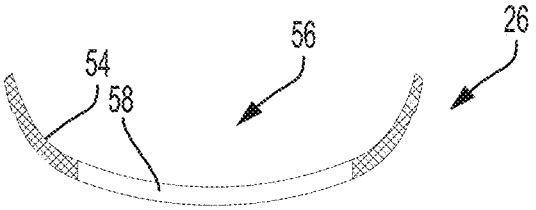
FIG. 25 is a cross-sectional view taken along the plane of line 25-25 of FIG. 16.

In the embodiments of FIGS. 1-27, the chassis member 26 is of a molded leather construction, and, in alternative embodiments, is of a thermoplastic polyurethane construction. The chassis member 26 provides support to the heel and toe of the user and provides rigidity to the shoe 20 such that the shoe 20 does not use a shank. In embodiments where the chassis member is of molded leather construction, the chassis 26 is formed from one or more leather bends with total thickness of between 3 and 5 millimeters, inclusive. The leather bend is planed to a uniform thickness and die cut to provide the outer perimeter of the chassis member 26, the cutout to accommodate the heel cushion 28, and the cutout to accommodate the forefoot cushion 30. The leather bend is machined (e.g., milled by a computer numerical control milling machine) to provide a tapered thickness from the center of the leather bend toward the perimeter of the leather bend. For example, and without limitation, the leather chassis 26 may have a 3 millimeter thick portion extending between the sole heel end 38, the sole toe end 40, the sole lateral edge 42, and the sole medial edge 44. The leather chassis 26 may have a 2 millimeter thick portion extending from the edges of the 3 millimeter thick portion corresponding to the portion of the chassis member 26 that curves upward in the completed shoe 20 (e.g., as shown in FIG. 2). From the 2 millimeter thick portion, the leather bend tapers in thickness outward. After the leather bend has been machined to provide for the above described thicknesses, it is soaked in water, pressed, heated, and steamed on a mold (e.g., a last). After a predetermined amount of dwell time, the molded leather chassis 26 has taken the shape of the mold such that it has been formed to the shape depicted herein (e.g., as shown in FIGS. 2 and 16-25).

The chassis member 26 extends from the sole heel end 38 to the sole toe end 40. The chassis member 26 includes a deck portion 54, a chassis member cavity 56, a heel 58, and a forefoot opening 60. The heel opening 58 is a through opening that extends through the chassis member 26, and the forefoot opening is a through opening that extends through the chassis member 26. The heel opening 58 is within the sole heel region 46, and the forefoot opening 60 is within one or more of the sole toe region 52, the sole ball region 50, and the sole midfoot region 48. The forefoot cushion 30 is positioned within the forefoot opening 60, and the heel cushion 28 is positioned within the heel opening 58, with both the forefoot opening 60 and the heel opening 58 sized to accommodate the corresponding cushion. The forefoot cushion 30 and the heel cushion 28 are flush with the deck portion 54 of the chassis member 26 and with the underside of the chassis member 26 opposite the deck portion 54.

The chassis member cavity 56 extends upwardly from the deck portion 54 with the sides of the chassis member 56 at least partially defining the cavity 56. The sides of the chassis member 56 are curved where they meet the deck portion such that the cavity 56 is generally cup shaped (e.g., as shown in FIGS. 16-25). Generally, portions of the side of the chassis member 26 closer to the sole toe end 40 curve upward with a greater radius than portions of the side of the chassis member 26 closer to the sole heel end 38. The shape of the chassis member 26 and the resulting cavity 56 allow the upper 24 to be positioned partially within the cavity 56 such that the chassis member 26 extends upwardly above a portion of the upper 24 (e.g., as shown in FIG. 1).

The chassis member 26 is adhered to the outsole 32 and is adhered to the upper 24. Similarly, the forefoot cushion 30 and the heel cushion 28 are adhered to the outsole 32 and to the upper 24. In some embodiments, the components of the shoe 20 may be coupled together using additional or alternative techniques (e.g., stitching).

The outsole 32 of the sole 22 includes a heel portion 62, a midfoot portion 64, a ball portion 66, and a toe portion 68. Generally, each portion of the outsole 32 corresponds to similarly named regions of the sole except as otherwise described herein (e.g., the toe portion 68 of the outsole 32 is within the sole to region 52). The heel portion 62 extends from the sole heel end 38 toward the sole midfoot region 48 and from the sole medial edge 44 to the sole lateral edge 42.

In some embodiments, and as depicted, the heel portion 62 of the outsole curves inward and convexly from the sole medial edge 64 toward the sole toe end 40 and to a first apex 70. The first apex 70 faces toward the sole toe end 40. The heel portion 62 also curves inward and convexly from the first apex 70 toward an inflection point 72 and a second apex 74. The inflection point 72 is positioned longitudinally between the first apex 70 and the second apex 74. The heel portion 62 curves inward and concavely from the inflection point 72 to the second apex 74. The second apex 74 facing toward the sole heel end 38. The heel portion 62 further curves inward and concavely away from the second apex 74 toward the sole lateral edge 42 and tapers toward the sole lateral edge 42 as the heel portion 62 extends toward the sole toe end 40.

Figure 26:
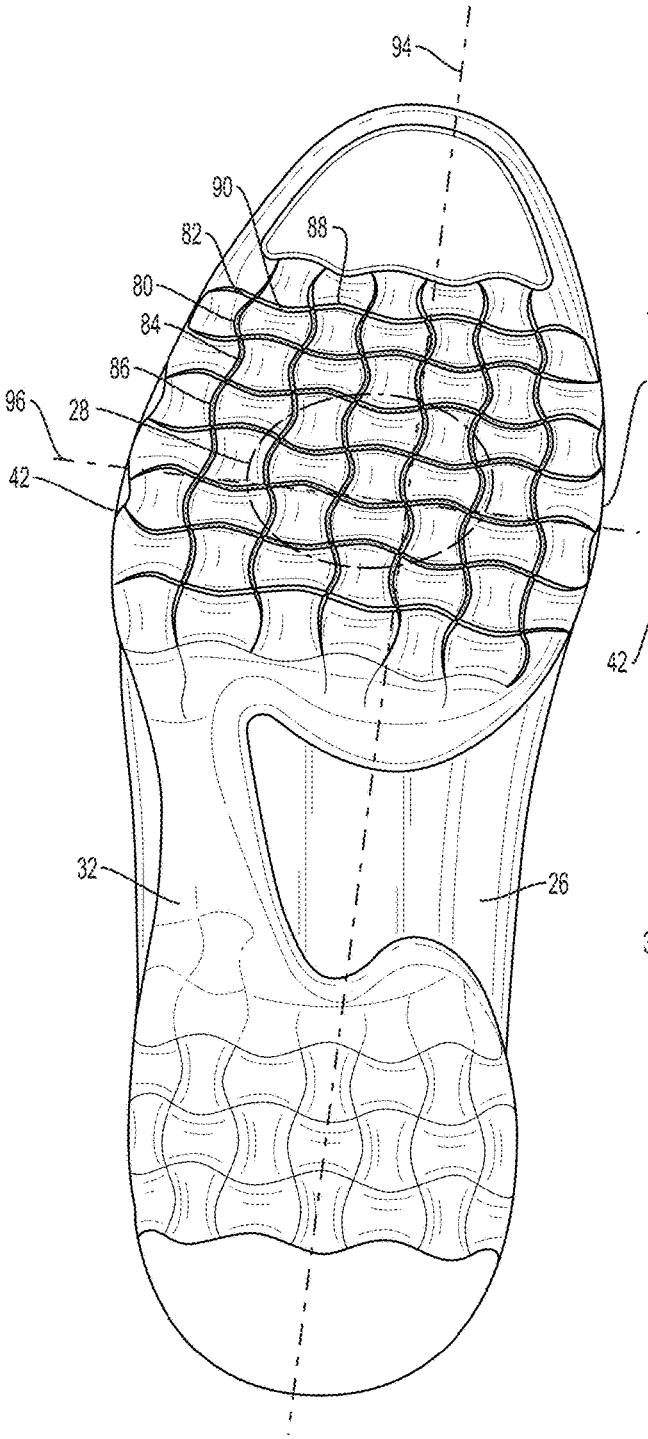
FIG. 26 is a bottom view of the shoe shown in FIG. 1.

The midfoot portion 64 extends from the heel portion 62 to the ball portion 66 and is only in the lateral midfoot region 34. The medial midfoot region 36 is devoid of the midfoot portion 64 of the outsole 32 such that the chassis member 26 is visible in the medial midfoot region 36 as viewed in a bottom plan view (e.g., as shown in FIG. 26). In some embodiments, the chassis member 26 may also extend laterally beyond the midfoot portion 64 of the outsole 32 such that the chassis member 26 is visible on the lateral side of the midfoot portion 64 as viewed in a bottom plan view. The chassis member 26 increases the rigidity of the sole 22 such that twisting of the shoe about a longitudinal axis is resisted. In this way, the chassis member 26 compensates for the narrow outsole midfoot portion 64. In other words, the chassis member 26 is secured to the outsole at least at both the heel portion 62 and the forefoot portion (e.g., ball portion 66 and toe portion 68) such that movement the heel portion 62 and the forefoot portion relative to one another is constrained and/or resisted by the rigidity of the chassis member 26. This allows for the midfoot portion 64 of the outsole 32 to be narrower in comparison to a shoe not including the chassis member 26.

In some embodiments, and as depicted, the midfoot portion 64 of the outsole 32 extends from the heel portion 62 to the ball portion 66 and extends between the two diagonally and laterally. The midfoot portion 64 also tapers in width to a narrowest width and then broadens outward as the midfoot portion 64 extends from the heel portion 62 to the ball portion 66. In alternative embodiments, the outsole 32 may include a midfoot portion 64 of a different shape.

The ball portion 66 of the outsole 32 extends from the midfoot portion 64 toward the sole toe end 40 and from the sole medial edge 44 to the sole lateral edge 42. In some embodiments, and as depicted, the ball portion 66 curves inward and convexly from the sole medial edge 44 toward the sole heel end 38 and to a third apex 76. The third apex 76 faces toward the sole heel end 38. The ball portion 66 further curves inward and convexly from the third apex 76 toward the sole lateral edge 42. The toe portion 68 of the outsole 32 extends from the ball portion 66 to the sole toe end 40 and from the sole medial edge 44 to the sole lateral edge 42.

The outsole 32 generally reduces in thickness as it extends from the sole heel end 38 toward the sole toe end 40. The heel portion 62 of the outsole 32 is thicker than the ball portion 66 and the toe portion 68. The midfoot portion 64 reduces in thickness between the heel portion 62 and the ball portion 64. The ball portion 66 is thicker than the toe portion 68.

The sides of the outsole 32 are curved such that the outsole 32 defines a cavity 78 and is generally cup shaped (e.g., as shown in FIGS. 10-15). Generally, portions of the side of the outsole 32 closer to the sole toe end 40 curve upward with a greater radius than portions of the side of the outsole 32 closer to the sole heel end 38. The shape of the outsole 32 and the resulting cavity 78 allows the molded chassis 26 to be positioned partially within the cavity 78 such that the outsole 32 extends upwardly above a portion of the molded chassis 26 (e.g., as shown in FIG. 1).

Figure 27:
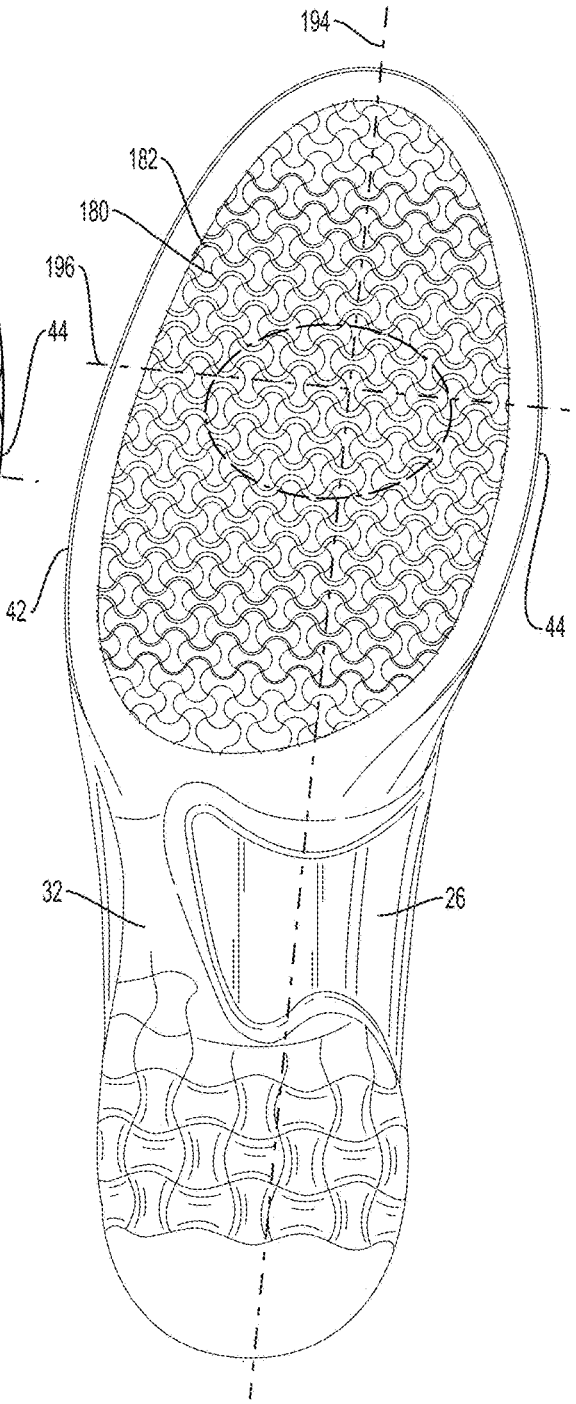
FIG. 27 is a bottom view of a shoe having an alternative outsole.
Figure 28:
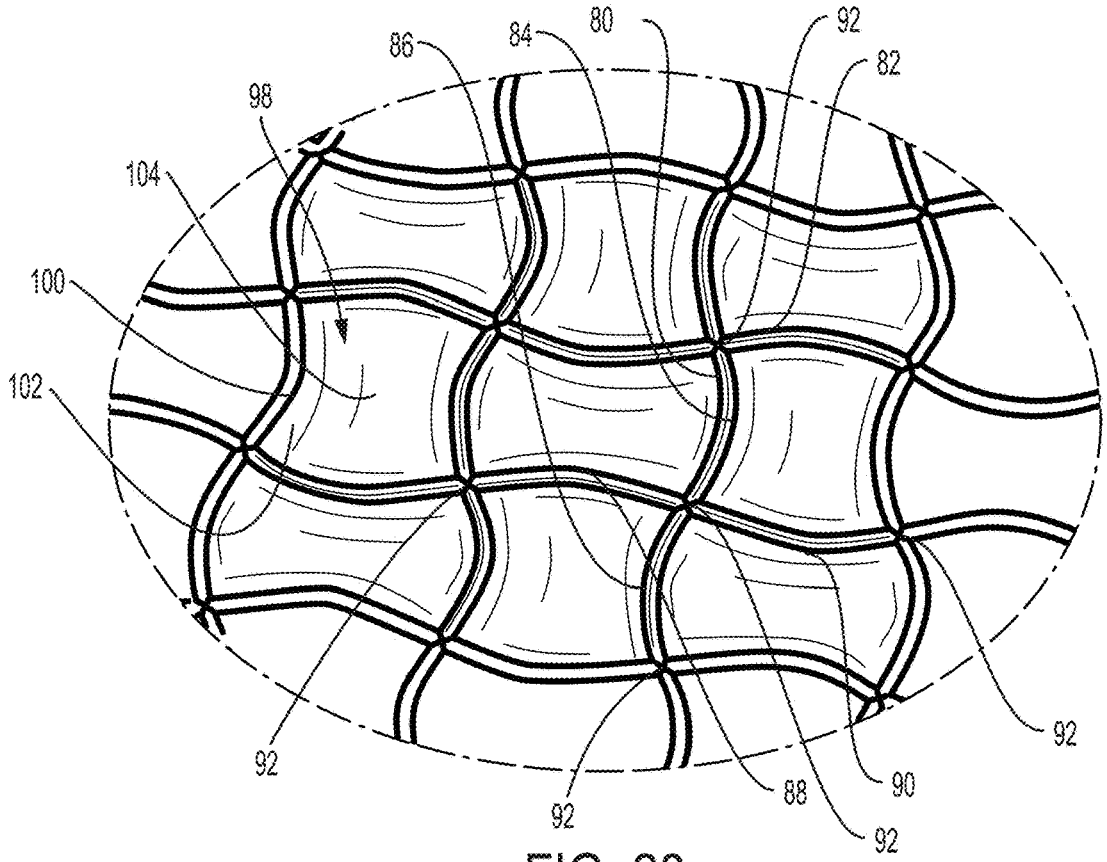
FIG. 28 is a detail view of the outsole shown in FIG. 26.
Figure 29:
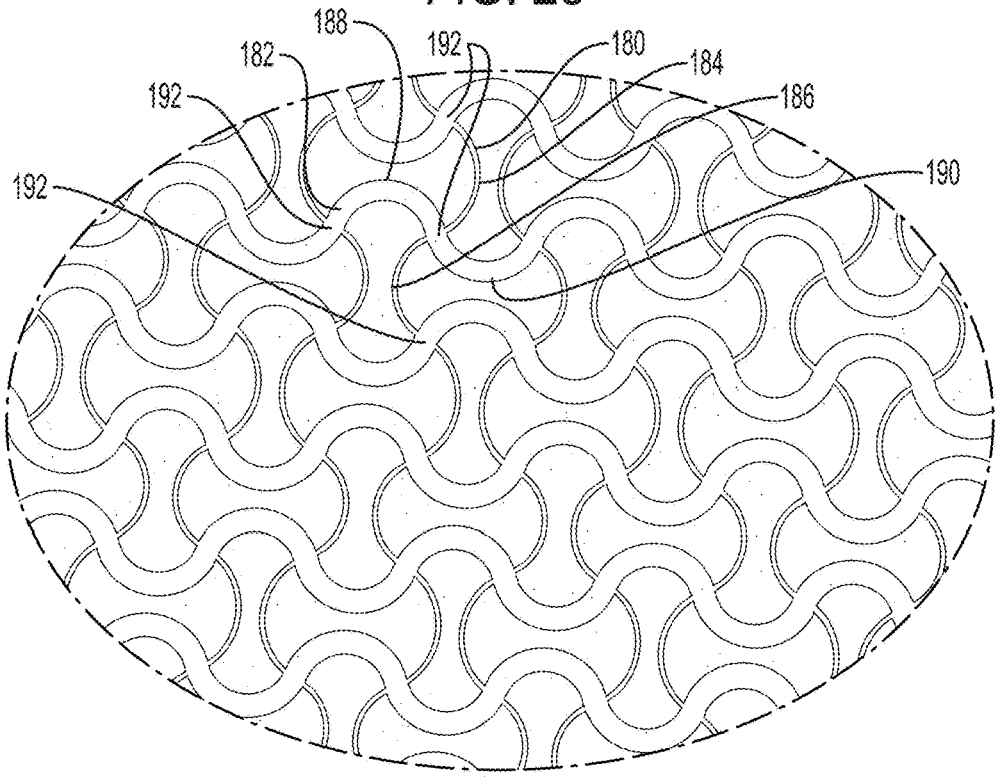
FIG. 29 is a detail view of the outsole shown in FIG. 27.

As shown in FIGS. 26-29, the outsole 32 includes a plurality of longitudinal sipes and a plurality of transverse sipes. A first embodiment is depicted in FIGS. 26 and 28 and described with reference to longitudinal sipes 80 and transverse sipes 82. A second embodiment is depicted in FIGS. 27 and 29 and described with reference to longitudinal sipes 180 and transverse sipes 182. Like part numbers indicate like components except as otherwise described. For example, trough 86 and trough 186 are the same.

Each longitudinal sipe 80,180 extends away from the sole heel end 38 and toward the sole toe end 40. Each transverse sipe 82,182 extends away from the sole lateral edge 42 and toward the sole medial edge 44. Each longitudinal sipe 80,180 extends upward from the bottom surface of outsole 32, and each transverse sipe 82,182 extends upward from the bottom surface. Each longitudinal sipe 80,180 is an undulating curve with peaks 84,184 and troughs 86,186, and each transverse sipe 82,182 is an undulating curve with peaks 88,188 and troughs 90,190. Each peak 84,184 of each longitudinal sipe 80,180 is closer to the sole medial edge 44 than an adjacent inflection point 92,192 of such same longitudinal sipe 80,180 is to the sole medial edge 44. Each trough 86,186 of each longitudinal sipe 80,180 is closer to the sole lateral edge 42 than an adjacent inflection point 92,192 of such same longitudinal sipe 80,180 is to the sole lateral edge 42. Similarly, for each transverse sipe 82,182, each peak 88,188 is closer to the sole toe end 40 than adjacent inflection points 92,192 of the same sipe, and each trough 90,190 is closer to the sole heel end 38 than adjacent inflection points 92,192 of the same sipe.

Each transverse sipe 82,182 intersects at least two of the longitudinal sipes 80,180 at intersection points, each intersection point being at one of the inflexion points 92,192 of one of the transverse sipes 82,182 and at one of the inflexion points 92,192 of one of the longitudinal sipes 80,180. Each transverse sipe 82,182 extends from the sole lateral edge 42 to the sole medial edge 44. Each longitudinal sipe 80,180 may undulate about a midline, with the midline being parallel to a longitudinal centerline 94, 194 running between the sole heel end 38 and the sole toe end 40 and being perpendicular to a transverse centerline 96, 196 running between the sole medial edge 44 and the sole lateral edge 42. Each transverse sipe may undulate about a midline parallel to the transverse centerline 96,196.

In some embodiments, at least one longitudinal sipe 80 has more than six inflection points 92 within a forefoot region of the sole where the forefoot region includes the ball region 50 and the toe region 52. In alternative embodiments, this region includes different numbers of inflection points 92. The outsole 32 includes a plurality of recesses 98 defined in part by longitudinal sipes 80 and lateral 82 sipes. Each recess 98 has a perimeter 100, a ridge 102, and a center 104. The ridge 102 extends along the perimeter 100, and the center 104 is depressed (e.g., extends upward into the outsole 32) relative to the ridge 102 when viewed in a bottom plan view. Each recess is bounded by two longitudinal sipes 80 and two transverse sipes 82. Each recess 98 may slope convexly from the ridge 102 toward the center 104, and, in some embodiments, the center 104 is at a greater depth than each longitudinal sipe 80 bounding the recess 98 and each transverse sipe 82 bounding the recess 98.

In some embodiments, each transverse sipe 182 has a first width and each longitudinal sipe 180 has a second width, with the first width being greater than the second width. And, in some embodiments, each transverse sipe 82 and each longitudinal sipe 80 are sinusoidal. The longitudinal sipes 80 and the transverse sipes 82 may have a constant period or may have a period that varies along the length of the sipe 80,82. The sipes 80,82 may also have an amplitude that varies along the length of the sipe 80,82. The longitudinal sipes 80 may have a first period and the transverse sipes 82 may have a second period, with the first and second periods being different.

As various modifications could be made in the constructions and methods herein described and illustrated without departing from the scope of the disclosure, it is intended that all matter contained in the foregoing description or shown in the accompanying drawings shall be interpreted as illustrative rather than limiting. Thus, the breadth and scope of the present disclosure should not be limited by any of the above-described exemplary embodiments, but should be defined only in accordance with the following claims appended hereto and their equivalents.

It should also be understood that when introducing elements of the present disclosure in the claims or in the above description of exemplary embodiments of the disclosure, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A shoe comprising:

a sole; and an upper secured to the sole;

the sole extending longitudinally from a sole heel end to a sole toe end and extending transversely from a sole lateral edge to a sole medial edge, the sole including a heel region, a midfoot region, a ball region and a toe region, the heel region extending longitudinally from the sole heel end to the midfoot region, the midfoot region extending longitudinally from the heel region to the ball region and having a lateral midfoot region and a medial midfoot region, the lateral midfoot region extending transversely from the lateral edge to the medial midfoot region, the medial midfoot region extending transversely from the medial edge to the lateral midfoot region, the ball region of the sole extending longitudinally from the midfoot region to the toe region, and the toe region extending longitudinally from the ball region to the sole toe end, the sole having an outsole and a chassis, the outsole having a heel portion, a midfoot portion, a ball portion, and a toe portion, the heel portion extending from the sole heel end toward the midfoot region and from the sole medial edge to the sole lateral edge, the midfoot portion extending from the heel portion to the ball portion and being only in the lateral midfoot region, the medial midfoot region being devoid of the midfoot portion of the outsole such that the chassis is visible as viewed in a bottom plan view, the ball portion of the outsole extending from the midfoot portion toward the sole toe end and from the sole medial edge to the sole lateral edge, the toe portion of the outsole extending from the ball portion to the sole toe end and from the sole medial edge to the sole lateral edge, the chassis coupled to the outsole and coupled to the upper, wherein the outsole further comprises a bottom surface, a plurality of longitudinal sipes, and a plurality of transverse sipes, each sipe of the plurality of longitudinal sipes extending away from the sole heel end and toward the sole toe end, each sipe of the plurality of transverse sipes extending away from the sole lateral edge and toward the sole medial edge, each sipe of the plurality of longitudinal sipes extending upward from the bottom surface, each sipe of the plurality of transverse sipes extending upward from the bottom surface, each longitudinal sipe being an undulating curve with peaks and troughs, each transverse sipe being an undulating curve with peaks and troughs, each peak of each longitudinal sipe being closer to the sole medial edge than an adjacent inflection point of the same longitudinal sipe to the sole medial edge, each trough of each longitudinal sipe being closer to the sole lateral edge than an adjacent inflection point of the same longitudinal sipe to the sole lateral edge; and wherein each transverse sipe intersects at least two of the longitudinal sipes at intersection points, each intersection point being at one of the inflexion points of one of the transverse sipes and at one of the inflexion points of one of the longitudinal sipes.

2. A shoe as set forth in claim 1 wherein the sole includes a forefoot region, the forefoot region including the ball region and the toe region, and wherein at least one of the longitudinal sipes has more than six inflection points in the forefoot region of the sole.

3. A shoe comprising:

a sole; and an upper secured to the sole;

the sole extending longitudinally from a sole heel end to a sole toe end and extending transversely from a sole lateral edge to a sole medial edge, the sole including a heel region, a midfoot region, a ball region and a toe region, the heel region extending longitudinally from the sole heel end to the midfoot region, the midfoot region extending longitudinally from the heel region to the ball region and having a lateral midfoot region and a medial midfoot region, the lateral midfoot region extending transversely from the lateral edge to the medial midfoot region, the medial midfoot region extending transversely from the medial edge to the lateral midfoot region, the ball region of the sole extending longitudinally from the midfoot region to the toe region, and the toe region extending longitudinally from the ball region to the sole toe end, the sole having an outsole and a chassis, the outsole having a heel portion, a midfoot portion, a ball portion, and a toe portion, the heel portion extending from the sole heel end toward the midfoot region and from the sole medial edge to the sole lateral edge, the midfoot portion extending from the heel portion to the ball portion and being only in the lateral midfoot region, the medial midfoot region being devoid of the midfoot portion of the outsole such that the chassis is visible as viewed in a bottom plan view, the ball portion of the outsole extending from the midfoot portion toward the sole toe end and from the sole medial edge to the sole lateral edge, the toe portion of the outsole extending from the ball portion to the sole toe end and from the sole medial edge to the sole lateral edge, the chassis coupled to the outsole and coupled to the upper, wherein the outsole further comprises a bottom surface, a plurality of longitudinal sipes, and a plurality of transverse sipes, each sipe of the plurality of longitudinal sipes extending away from the sole heel end and toward the sole toe end, each sipe of the plurality of transverse sipes extending away from the sole lateral edge and toward the sole medial edge, each sipe of the plurality of longitudinal sipes extending upward from the bottom surface, each sipe of the plurality of transverse sipes extending upward from the bottom surface, each longitudinal sipe being an undulating curve with peaks and troughs, each transverse sipe being an undulating curve with peaks and troughs, each peak of each longitudinal sipe being closer to the sole medial edge than an adjacent inflection point of the same longitudinal sipe to the sole medial edge, each trough of each longitudinal sipe being closer to the sole lateral edge than an adjacent inflection point of the same longitudinal sipe to the sole lateral edge; and wherein each longitudinal sipe undulates about a midline, the midline being parallel to a longitudinal centerline running between the sole heel end and the sole toe to end and being perpendicular to a transverse centerline running between the sole medial edge and the sole lateral edge, and wherein each transverse sipe undulates about a midline parallel to the transverse centerline.

4. A shoe comprising:

a sole; and an upper secured to the sole;

the sole extending longitudinally from a sole heel end to a sole toe end and extending transversely from a sole lateral edge to a sole medial edge, the sole including a heel region, a midfoot region, a ball region and a toe region, the heel region extending longitudinally from the sole heel end to the midfoot region, the midfoot region extending longitudinally from the heel region to the ball region and having a lateral midfoot region and a medial midfoot region, the lateral midfoot region extending transversely from the lateral edge to the medial midfoot region, the medial midfoot region extending transversely from the medial edge to the lateral midfoot region, the ball region of the sole extending longitudinally from the midfoot region to the toe region, and the toe region extending longitudinally from the ball region to the sole toe end, the sole having an outsole and a chassis, the outsole having a heel portion, a midfoot portion, a ball portion, and a toe portion, the heel portion extending from the sole heel end toward the midfoot region and from the sole medial edge to the sole lateral edge, the midfoot portion extending from the heel portion to the ball portion and being only in the lateral midfoot region, the medial midfoot region being devoid of the midfoot portion of the outsole such that the chassis is visible as viewed in a bottom plan view, the ball portion of the outsole extending from the midfoot portion toward the sole toe end and from the sole medial edge to the sole lateral edge, the toe portion of the outsole extending from the ball portion to the sole toe end and from the sole medial edge to the sole lateral edge, the chassis coupled to the outsole and coupled to the upper, wherein the outsole further comprises a bottom surface, a plurality of longitudinal sipes, and a plurality of transverse sipes, each sipe of the plurality of longitudinal sipes extending away from the sole heel end and toward the sole toe end, each sipe of the plurality of transverse sipes extending away from the sole lateral edge and toward the sole medial edge, each sipe of the plurality of longitudinal sipes extending upward from the bottom surface, each sipe of the plurality of transverse sipes extending upward from the bottom surface, each longitudinal sipe being an undulating curve with peaks and troughs, each transverse sipe being an undulating curve with peaks and troughs, each peak of each longitudinal sipe being closer to the sole medial edge than an adjacent inflection point of the same longitudinal sipe to the sole medial edge, each trough of each longitudinal sipe being closer to the sole lateral edge than an adjacent inflection point of the same longitudinal sipe to the sole lateral edge; and wherein the outsole includes a plurality of recesses, each of the recesses having a perimeter, a ridge, and a center, the ridge extending along the perimeter, the center being depressed relative to the ridge, and wherein each recess is bounded by two longitudinal sipes and two transverse sipes.

5. A shoe as set forth in claim 4 wherein each recess slopes convexly from the ridge toward the center.

6. A shoe as set forth in claim 4 wherein the center is at a greater depth than each longitudinal sipe bounding the recess and each transverse sipe bounding the recess.

* * * * *